US006883732B2

(12) United States Patent
Hasegawa

(10) Patent No.: US 6,883,732 B2
(45) Date of Patent: Apr. 26, 2005

(54) FLUID SPRAYING APPARATUS, METHOD, AND CONTAINER

(75) Inventor: Kaga Hasegawa, Tokyo (JP)

(73) Assignee: Need Brain Co., Ltd., Tokyo (JP)

( * ) Notice: Subject to any disclaimer, the term of this patent is extended or adjusted under 35 U.S.C. 154(b) by 0 days.

(21) Appl. No.: 10/084,629

(22) Filed: Feb. 27, 2002

(65) Prior Publication Data

US 2003/0029933 A1 Feb. 13, 2003

(30) Foreign Application Priority Data

Feb. 27, 2001 (JP) ..... 2001-052618

(51) Int. Cl.[7] ..... B05B 7/12; F23D 11/10; F23D 11/40; F23D 14/62

(52) U.S. Cl. ..... 239/416.5; 239/417.3; 239/418; 239/423; 239/318; 239/602

(58) Field of Search ..... 239/416.5, 417.3, 239/418, 423, 318, 283, 310, 229, 375, 378, 413, 405, 406, 416.4, 288, 288.3, 288.5, 290, 434.5, 424, 424.5, 587.1, 588, 602

(56) References Cited

U.S. PATENT DOCUMENTS 4,044,953 A * 8/1977 Vogel ..... 239/229
5,052,623 A * 10/1991 Nordeen ..... 239/305
5,533,673 A * 7/1996 Wilson et al. ..... 239/227
5,725,153 A * 3/1998 Wang et al. ..... 239/102.1
6,003,787 A * 12/1999 Fisher ..... 239/373
6,126,086 A * 10/2000 Browner et al. ..... 239/102.1

FOREIGN PATENT DOCUMENTS

| | | |
|---|---|---|
| JP | H04-37635 | 9/1992 |
| JP | H10-286494 | 10/1998 |
| JP | H11-123350 | 5/1999 |
| JP | 2000-51800 | 2/2000 |
| JP | 2001-104840 | 4/2001 |

* cited by examiner

*Primary Examiner*—Michael Mar
*Assistant Examiner*—Darren Gorman
(74) *Attorney, Agent, or Firm*—Meyertons, Hood, Kivlin, Kowert & Goetzel, P.C.; Eric B. Meyertons

(57) ABSTRACT

Described herein is an apparatus for applying fluids to a surface. The apparatus includes a nozzle coupled to a pressurized gas supply source and a fluid supply source. The nozzle includes outer conduit and an inner conduit ¥positioned such that a gap is formed between the inner and outer conduits. The outer conduit is coupled to the pressurized gas supply source. The inner conduit is coupled to the fluid supply source. Gas passed through the gap between the inner and outer conduits pulls fluid from the fluid supply source and into the gas stream.

35 Claims, 5 Drawing Sheets

FLUID SPRAYING APPARATUS, METHOD, AND CONTAINER

PRIORITY CLAIM

This application claims priority to Japanese Patent Application No. 2001-052618 filed on Feb. 27, 2001.

BACKGROUND OF THE INVENTION

1. Field of the Invention

The present invention generally relates to an apparatus for applying fluids to a surface. More particularly, the present invention generally relates to an apparatus for applying fluids for cleaning, polishing or painting a surface.

2. Description of the Related Art

Many devices have been used for cleaning dust and dirt from a surface. Some such devices clean a surface by spraying a gas (e.g., compressed air) from an opening of a nozzle in a cleaning device. Other devices clean a surface by forcing a liquid, a powder, or a granular polishing agent through an opening of the device using a high-pressure air. Conventional device, therefore, tend to have a structure that uses high pressure air to push the cleaning fluid through a nozzle of the device.

Japanese Patent Publication No. JP11-123350 describes a device having a nozzle formed from a flexible cylindrical material. During use the nozzle moves in a circular pattern such that the fluid is ejected out in a pattern corresponding to the movement of the nozzle.

Japanese Patent Publication No. JP2000-51800 also describes a device having a nozzle formed from a flexible cylindrical material. During use the nozzle moves in a circular pattern such that the fluid is ejected out in a pattern corresponding to the movement of the nozzle. As schematically shown in FIG. 1, the device is equipped with a water supply source A, a compressed air source B, a detergent supply source C, a nozzle E, and conduits F1–F4 which couple the supply sources A, B, and C with nozzle E.

Compression air is sent into the water supply source A and the detergent supply source C by the compressed air source B. By operating a switch D coupled to nozzle E by conduit F4, the fluid in either of conduits F1, F2, or F3 is chosen and water, compressed air, or detergent may be ejected from nozzle E. The described apparatus of JP 2000-51800 relies on a structure that sends compressed air into a supply sources A and C to supply water or detergent with pressure to the nozzle E. The use a powered compressed air supply source B, a water supply source A and a detergent supply source C renders the device relatively large. Additionally, the device is in a gun-shaped form (E'). Because the device relies on three separate conduits F1–F3 to couple the supply sources with the structure E', these conduits tend to make the gun shaped structure difficult to handle. Finally, to alter the fluid used in the device supply source A and/or C may need to be replaced.

SUMMARY OF THE INVENTION

Described herein is a fluid spraying apparatus that is generally compact, easy to operate and may allow the easy change of the fluid being sprayed.

In one embodiment, a fluid spraying apparatus includes a nozzle composed of an outer conduit and an inner conduit inserted within a portion of the outer conduit. A gap may be formed between the inner conduit and the outer conduit to allow the passage of a gas between the conduits. A back portion of the outer conduit may be coupled to a pressurized gas supply source. A back portion of the inner conduit may be coupled to a fluid supply source. A fluid supply source may include a fluid.

The inner conduit may be coupled to the fluid supply source such that the fluids pass through the inner conduit and are ejected through a front portion of the inner conduit. The passage of gas through the outer conduit may create a suction force upon the front portion of the inner conduit. The suction force may draw fluid from the fluid supply source through and out of the inner conduit. The drawn out fluid may mix with the passing gas to form a mixture of fluid and gas that is expelled toward a surface. The passage of gas through the outer conduit may also induce movement of both the inner conduit and the outer conduit. The movement of the inner and outer conduits may occur simultaneously with the ejection of the gas and fluid.

The inner and outer conduits may be formed from a substantially flexible material. In some embodiments, the inner and outer conduits may be formed from a flexible polymeric material.

The fluid spraying apparatus may include a regulating member. The regulating member may be positioned proximate to the outer conduit of the nozzle. The regulating member may be configured to limit movement of the front portion of the outer conduit and the inner conduit during use. The regulating member may be substantially conical in shape. Alternatively, the regulating member may be annular in shape. A whisk may be coupled to the regulating member. The whisk may include a plurality of hair-like protrusions that extend along an inner surface of the whisk.

One or more balancing members may be coupled to an outer surface of the outer conduit. When multiple balancing members are used they may be positioned at spaced intervals along the outer conduit. Balancing members may control the inertial power of the nozzle as it moves within the regulating member.

The pressurized gas supply source may be a compressed air source. Alternatively, the gas supply source may be a compressor configured to generate compressed air. In another embodiment, the pressurized gas supply source may be an aerosol compressed air source.

The fluid supply source may apply a variety of fluids to the apparatus. Liquids may include cleaning solutions, polishing solutions, degreasing solutions, etc. Solids may include abrasive particles. Mixtures of liquids and solids may include pastes and polishing compounds that include suspensions of particles (e.g., abrasive particles).

Fluids used herein may include gases, solids, liquids, or a mixture of gases, solids and liquids. In certain embodiments the solids may include small (e.g., less than 100 micron average diameter, or 1–75 micron average diameter, or 3–50 micron average diameter) abrasive particles. In certain embodiments the average diameter of the particles may exceed 100 microns. Such particles may be calcium carbonate, silica, sand, alumina, Green Carborundum, ceramic materials, etc. Inclusion of particles (whether below or above 100 micron average diameter) may form an abrasive cleaning solution that, when applied with the apparatus, provide desirable results.

In certain embodiments the cleaning action of the apparatus and methods described herein may be enhanced by the use of gas and fluid to clean and/or treat a surface. Such cleaning and/or treating may, for example, occur by substantially simultaneous application of gas and fluid to the surface, thereby having the effect of substantially simulta neously cleaning and drying. In this manner a surface may be cleaned and dried more quickly and/or efficiently. The apparatus may be adjusted to, for example, cause of mist or spray of gas and liquids to the surface being cleaned.

In certain embodiments the addition of abrasive solids (e.g., particles) with the gas or liquid may serve to assist in the cleaning.

In certain embodiments the apparatus can be adjusted to apply either gas, gas and fluid, or gas, fluid, and solids. In this manner a user can, for example, apply gas and fluid (or gas, fluid and solids) to a surface. Such application can, for example, be preceded or following by the application of gas only, or gas and fluid, to enhance the application to the surface. It will be appreciated that various combinations, and various steps, of gas, gas and fluid, and/or gas, fluid, and solids can be applied, depending the nature of the surface or the application.

In certain embodiments an opening or hook may be attached to the apparatus described herein. Such an opening or hook may allow the apparatus to be hung from a wall or hanger for more easy handling.

In certain embodiments all or a portion of the apparatus described herein may include a "sight opening" or clear section to allow the user of the apparatus to see gas, fluids, or solids moving within the apparatus and being applied by the apparatus. In certain embodiments all or a portion of the apparatus is clear. In certain embodiments it is useful to determine, for example, the level of liquid in a fluid supply source by visually looking at a clear container for same.

The apparatus described herein may be used to apply fluids to a variety of surfaces. In some embodiments, the apparatus may be used to apply fluids to the surface of a vehicle to clean, polish, wax, and/or treat surfaces (e.g., surfaces of the vehicle). Such apparatus may be useful for surfaces that are irregularly shaped such that they cannot be easily cleaned and/or treated with towels, grinders, polishers, hand cleaning, etc. As used herein the term vehicle includes, automobiles, trucks, trains, planes, and boats. Other surfaces may include walls of buildings (e.g., the application of paint), and floors (e.g., the application of waxes or polishes).

BRIEF DESCRIPTION OF THE DRAWINGS

Other objects and advantages of the invention will become apparent upon reading the following detailed description and upon reference to the accompanying drawings in which.

Figure 1:
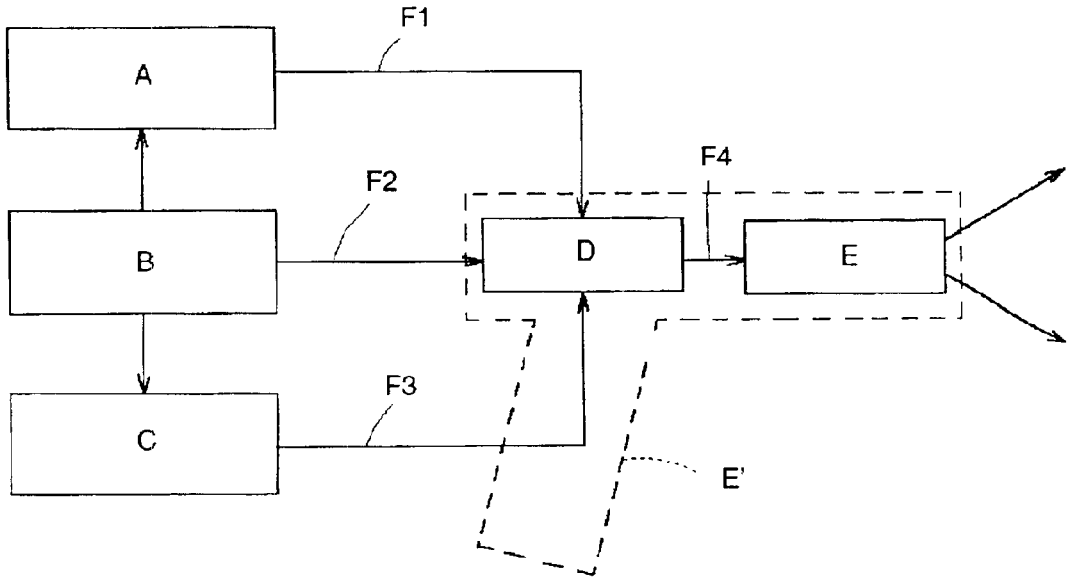
FIG. 1 (Prior Art)
FIG. 1 is a schematic representation of a conventional fluid spraying apparatus.

While the invention is susceptible to various modifications and alternative forms, specific embodiments thereof are shown by way of example in the drawing and will herein be described in detail. It should be understood, however, that the drawings and detailed description thereto are not intended to limit the invention to the particular form disclosed, but on the contrary, the intention is to cover all modifications, equivalents, and alternatives falling withinthe spirit and scope of the present invention as defined by the appended claims.

DETAILED DESCRIPTION OF THE INVENTION

Spraying devices are described in the following Japanese Patent Applications all of which are incorporated herein by reference: Japanese Publication No. 2000-51800; Japanese Publication No. H11-123350; Japanese Publication No. H04-37635; Japanese Publication No. H10-286494; and Japanese Publication No. 2001-104840.

Figure 2:
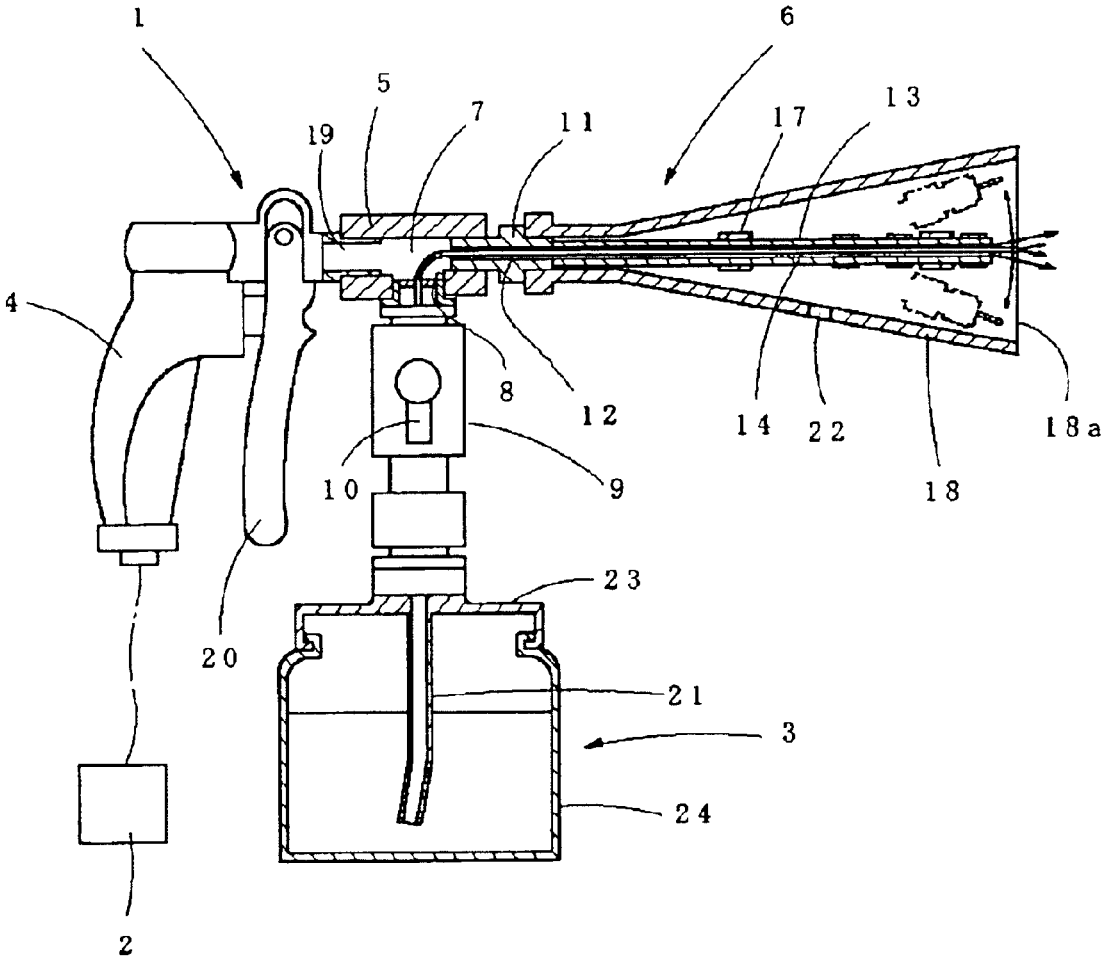
FIG. 2 is a partial cross sectional view of a fluid spraying apparatus.
Figure 3:
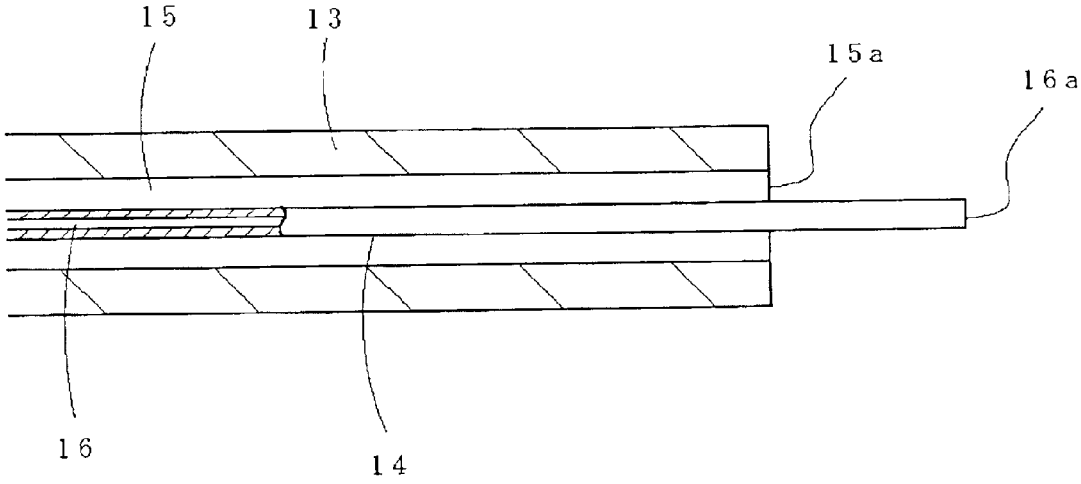
FIG. 3 is a cross-sectional view of the nozzle portion of a fluid spraying apparatus.

FIG. 2 shows a partial cross sectional view of an embodiment of a fluid spraying apparatus. FIG. 3 depicts a cross-sectional view of the nozzle portion of an embodiment of a fluid spraying apparatus. The fluid spraying apparatus 1 may include a pressurized gas supply source 2, and/or a fluid supply source 3 configured to hold a fluid.

Fluid spraying apparatus 1 may include a nozzle 6 coupled to a gun shaped body 4 by, for example, a connecting member 5. Connecting member 5 may include a first opening 7 configured to allow a gas to pass from pressurized gas supply source 2 to the nozzle 6. Connecting member 5 may also include a second opening 8 communicating with first opening 7. Fluid supply source 3 may be coupled to second opening 8 by means of valve 9.

Nozzle 6 includes an inner conduit 14 disposed within an outer conduit 13. An installation member 11 is coupled to a front end of connecting member 5. Installation member 11 includes an opening 12 configured to receive inner conduit 14. A base end of outer nozzle 13 may be fixed to a front end of installation member 11.

Inner conduit 14 is positioned within outer conduit 13 such that a gas flow path 15 is formed between an inner-surface of the outer conduit 13 and an outer-surface of the inner conduit 14. Gas flow path 15 communicates with the first opening 7 of connecting member 5 through opening 12 of installation member 11. A rear portion of inner conduit 14 extends through opening 12 of installation member 11 and into the first opening 7 of connecting member 5. The rear portion further extends into second opening 8 of connecting member 5, and is thus coupled to valve 9. Inner conduit includes an opening 16 through which a fluid passed during use.

Outer conduit 13 may be composed of a flexible polymeric material. Examples of flexible polymeric materials include, but are not limited to, nylon, polytetrafluoroethylenes (e.g., Teflon), polyurethane, and polypropylene. Inner conduit 14 may also be composed of a flexible polymeric material. Inner conduit 14 may be composed of the same material as outer conduit 13. In some embodiments, only the portion of the inner conduit that is disposed within outer conduit 14 may be formed from a polymeric flexible material.

Gas passing through gas flow path 15 between the outer conduit 13 and the inner conduit 14 it is ejected from an end 15*a* of outer conduit 13 (see FIG. 3). As the gas is ejected, the portion of outer conduit 13 and inner conduit 14 extending from the base end of outer conduit 13 moves with respect to the body 4. Movement of the inner and outer conduits may be in a gyrating or reciprocating movement due to the flexibility of the conduits.

An end 16*a* of inner conduit 14 extends beyond end 15*a* of outer conduit 16*a*. As gas is ejected from outer conduit 13, a negative pressure area is formed outside end 15*a*. End 16*a* of inner conduit 14 is positioned within the negative pressure region generated by the passage of gas through outer conduit 13.

One or more balancing members 17 may be coupled to an outer surface of outer conduit 13, as depicted in FIG. 2. Balancing members may be formed of a polymeric material. When multiple balancing members are used they may be positioned at spaced intervals along outer conduit 13. Balancing members 17 control the inertial power of the nozzle as it moves within the regulating member 18.

A regulating member 18 may be coupled to the installation member 11. Regulating member 18 may be configured to restrict movement of nozzle 6. In one embodiment, regulating member may have a substantially conical shape as depicted in FIG. 2. Regulating member may be formed from a polymeric material or metal. A front opening of regulating member 18 may project past a front end of nozzle 6. As nozzle 6 moves, the movement of nozzle 6 may be restricted by contact with an inner surface of regulating member 18. Thus, movement of nozzle 6 may be restricted to a predetermined area. An opening 22 may be formed in a portion of regulating member 18 to allow rotation of nozzle 6 during use. In an alternate embodiment an opening such as opening 22 may serve to prevent over/under pressurization conditions in the nozzle 6 if, for example, nozzle 6 is pressed against a surface.

Pressurized gas supply source 2 may, in some embodiments, be an air compressor. Other gases that may be used include nitrogen or noble gases. Pressurized gas supply source 2 may be coupled to body 4 via conduit 19. Body 4 includes a passage (not depicted) which conducts pressurized gas from pressurized gas supply source 2 into first opening 7 of connecting member 5. Body 4 may include a switch 20 coupled to body 4. Switch 20 may be in the shape of a gun trigger. Switch 20 may be coupled to an internal valve (not depicted) within body 4 that is configured to allow or inhibit the flow of gas through body 4.

Pressure gas sent into the first opening 7 enters gas flow path 15 by way of opening 12 of installation member 11. While switch 20 is activated, the passages in body 4 coupling conduit 19 to opening 7 are maintained in an open position, thus allowing gas to flow from pressurized gas supply source 2 to nozzle 6. While switch 20 is inactivated, the passages in body 4 coupling conduit 19 to opening 7 are maintained in a close position, thus inhibiting gas from flowing from pressurized gas supply source 2 to nozzle 6.

Fluid supply source 3 is removably coupled to valve 9. Fluid supply source 3 is configured to store fluids. As used herein, a fluid may include a liquid, a solid or a mixture of liquids and solids. Liquids may include water, silicon based solutions, cleaning solutions, polishing solutions, detergents, soaps, degreasing solutions, etc. Solids may include abrasive particles. Mixtures of liquids and solids may include pastes and polishing compounds that include suspensions of abrasive particles. Insertion pipe 21 is coupled to a base portion of inner nozzle 14 through valve 9. Insertion pipe 21 extends into fluid supply source 3. Fluid supply source 3 may include a cover 23 coupled to a main body 24. Fluid supply source 3 may be removably coupled to valve 9 using a suitable coupling mechanism (e.g., a screw mechanism).

During use fluid supply source 3 may be coupled onto valve 9 of a fluid spraying apparatus. The switch 10 of valve 9 is set in an open position when coupling the fluid supply source 3 to the valve to allow a fluid connection between insertion pipe 21 and inner conduit 14.

In some embodiments, the pressurized gas supply source 2 may be a compressor. If a compressor is used, the compressor may be activated to generate compressed air. Alternatively, pressurized gas supply source 2 may be a tank of pre-compressed air. Switch 20 of body 4 may be activated to allow compressed air to flow through gas flow path 15 of outer conduit 13 via conduit 19, first opening 7, and opening 12 from the pressurized gas supply source 2. This combination of conduits and openings constitute a primary communication path. Pressurized gas that flows along the primary communication path is forcefully ejected from outer conduit 13 through end 15*a*. As gas is ejected, outer conduit 13 and inner conduit 14 will begin to move. The back portion of the inner and outer conduits are fixed, while the front portions of the inner and outer conduits are free to move. The front portions of the inner and outer conduits are formed from a flexible material. The movement of the inner and outer conduits may be limited to a predetermined area by regulating member 18 which surrounds at least a portion of outer conduit 13. Thus the front portion of the nozzle 6 moves within regulating member 18. Balancers 17 may be coupled to an outer surface of nozzle 13 to stabilize movement of nozzle 6.

When gas is ejected from outer nozzle 13, an area of negative pressure acts on end 16*a* of the inner conduit 14. Fluid in the fluid supply source 3 may be pulled into the ejected gas stream through inner conduit 13 and insertion pipe 21 by the negative pressure area. The route by which the fluid flows through constitutes the second communication path.

The produced combination of fluid and gas is ejected away from outer conduit 13. Simultaneous with the ejection of the fluid gas mixture, nozzle 6 may be moving. In some embodiments, nozzle 6 may be rotating in a substantially circular pattern to produce a circular spray of the fluid. The ejected fluid contacts the surface providing the desired cleaning or polishing effect.

The movement of nozzle 6 may be limited by regulating member 18 to a predetermined area. In some embodiments, movement of the nozzle 6 may be in a circular pattern. Movement of nozzle 6 in a circular pattern may provide additional force to the ejected mixture of gas and fluid. Therefore, ejected mixture of gas and fluid may have an increased power with respect to flow from a fixed nozzle.

The use of a single conduit 19 coupled to body 4 may improve the reliability of the fluid spraying device. Additionally, the positioning of fluid supply source 3 between body 4 and nozzle 6 improves the balance of the device. When necessary, changing or replenishing the fluid may be accomplished by replacing fluid supply source 3 with a new fluid supply source or by refilling the depleted fluid supply source 3.

The fluid may be inhibited from flowing through nozzle 6 by operation of switch 10. When the switch 10 is set in a closed position and the switch 20 is activated, as described above, gas from pressurized gas supply source 2 passes through the primary communication path and is ejected from nozzle 6. Fluid from fluid supply source 3, may be inhibited from entering inner conduit 14 by valve 9 which is in a closed position. In this manner a stream of pressurized gas may be directed to the surface. The stream of ejected gas may be used to blow and remove dust and dirt from the surface. A gas stream may also be used to dry a surface after, for example, a cleaning or painting operation.

Figure 4:
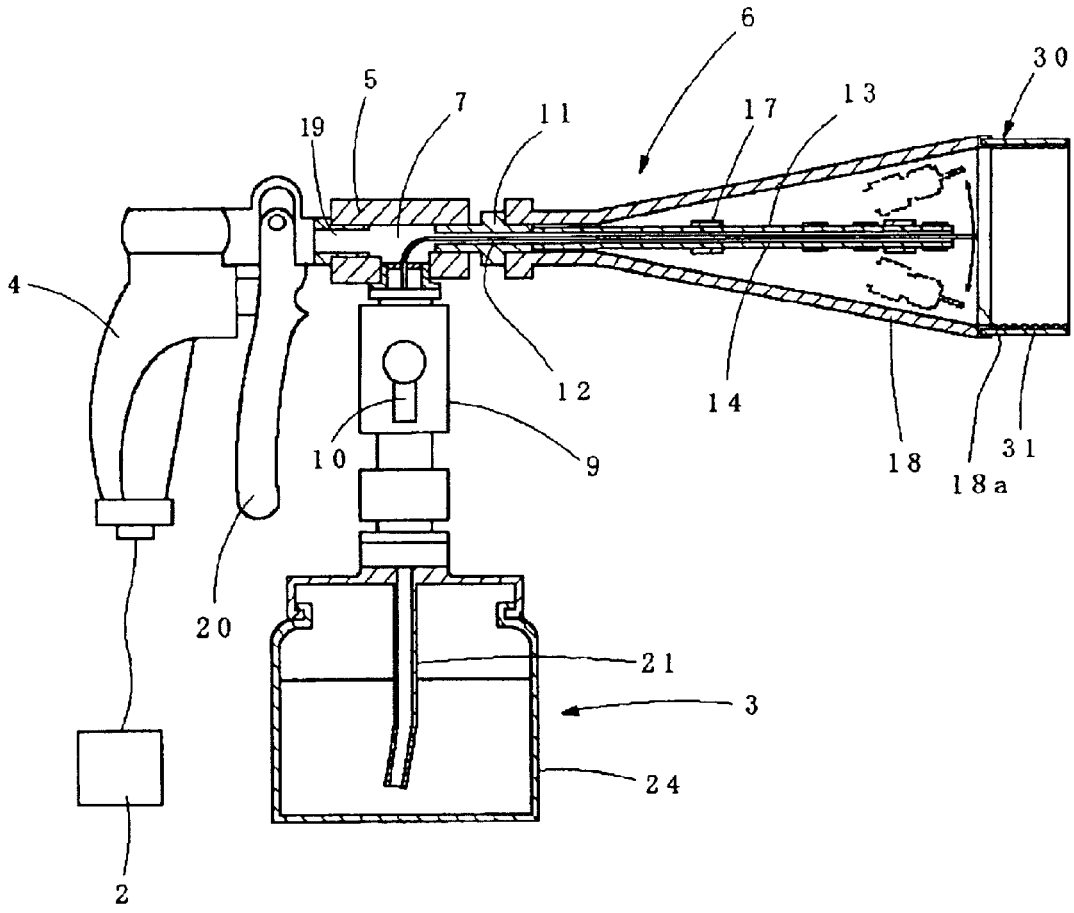
FIG. 4 is a partial cross sectional view of an alternate embodiment of a fluid spraying apparatus.

FIG. 4 depicts a partial cross sectional view of an alternate embodiment of a fluid spraying apparatus. The depicted apparatus has the same basic structure of the fluid spraying apparatus shown in FIG. 1. In addition, an annular whisk 30 may be installed along an end 18*a* of the opening of the regulating member 18. Annular whisk 30 may include a plurality of hair-like protrusions 31 on an inner surface of whisk 30. The hair like protrusions may be oriented along the longitudinal axis of the regulating member 18.

The mixture of gas and fluid that is ejected from nozzle 6 may spray out along the internal circumference surface of regulating member 18. Each hair-like protrusion 31 of annular whisk 30 may be bent over the ejected mixture of gas and fluid contacts the flow of the the mixture of gas and fluid is discontinued. In this manner, hair-like protrusions 31 of whisk 30 may move into a distorted position according to the movement of the ejected mixture of gas and fluid. When whisk 30 touches the surface to be washed, the surface may be washed by the hair-like protrusions in a pattern corresponding to the pattern of movement of the nozzle.

Figure 5:
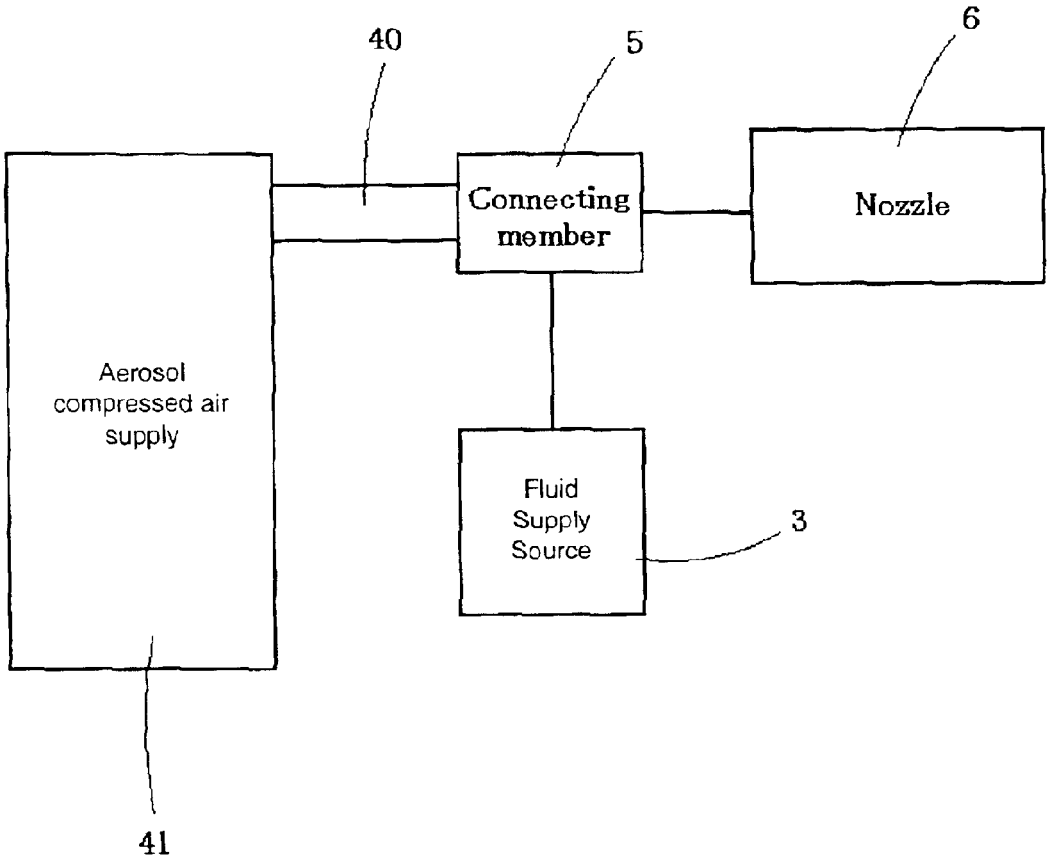
FIG. 5 is a schematic representation of a fluid spraying apparatus.

In some embodiments, the pressurized gas supply source may be an aerosol compressed air supply. In this case, connecting member 5 as shown in FIG. 1 and FIG. 3 may be coupled to the nozzle member 6 along an upper part of the compression air supply container. Nozzle 6 and fluid supply source 3 may be coupled to connecting member 5. FIG. 5 shows a schematic view of an embodiment of the fluid spraying apparatus. In the description of the embodiment of FIG. 5, the same components as those in the embodiment described in FIG. 1 and FIG. 3 are indicated with the same reference numerals.

The aerosol compressed air supply 41 may include a nozzle member 40 and may replace body 4 depicted in FIGS. 1 and 3. The use of an aerosol compressed air supply may allow the apparatus to be more compact in size and lighter in weight.

A bypass may be positioned along the flowing path of the outer conduit. A valve to change a flow to the bypass side may be positioned to allow a suction force to act on the spout of the outer conduit. Moreover, by setting up the bypass along the flowing path, dust sucked in from outer conduit end may be led into the bypass and can be collected.

The regulating guide member may limit movement of the front portion of the nozzle in some predetermined area. Therefore, for example, the regulation guide member may be composed of any kind of annular member, which covers a portion of the outside surface of the outer conduit having an appropriate spacing between the annular member and the nozzle to allow the desired movement.

In an embodiment, a negative pressure area may be created around the end of the inner conduit. As such negative pressure area is created, gas may be ejected from the outer conduit, the fluid may be pulled from the fluid supply source into the gas by the suction force created by the negative pressure areas. In this manner the fluid may be expelled from the nozzle without the need to pressurize the fluid supply source. Additionally, it is possible to make create an atomized spray of the fluid due to the force of ejection created by the gas flow.

Since the nozzle moves when the gas passes through the outer conduit, the fluid may be applied in a dynamic, rather than static manner. As used herein dynamic application of fluid refers to the application of fluids using moving nozzles. As used herein static application of fluids refers to the application of fluids from a fixed nozzle. It is believed that the dynamic application of fluids creates a more effective cleaning or washing process. Also, by providing a regulation member, the movement of the nozzle may be limited to a predetermined area. A whisk, described earlier, that include hair-like projections may be used to improve the uniformity of the application of the fluid.

The device does not require the pressurization of the fluid to operate. By avoiding pressurization of the fluid, the device may be more compact and easier to handle then other devices. The use of a removable fluid supply source allows the fluid to be easily replaced or interchanged.

In some embodiments two or more fluid supply sources may be used. Such fluid supply sources may be coupled to one conduit or multiple conduits in the device. In certain embodiments a valve or switch may be used by a user to vary the amount of fluid from each of the fluid supply sources. In this manner multiple fluids may, for example, be simultaneously or serially applied to a surface. For example, in one embodiment a first fluid (or fluid and solid, or fluid, gas and solid) may be applied from a first fluid supply source and then a second different fluid (or fluid and solid, or fluid, gas and solid) may be applied.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A fluid spraying nozzle comprising:

an outer conduit; and an inner conduit positioned within at least a portion of the outer conduit such that a gap is formed between the outer conduit and the inner conduit;

wherein a back portion of the outer conduit is coupled to a pressurized gas supply source, wherein a back portion of the inner conduit is coupled with a fluid supply source, the fluid supply source being configured to supply a non-pressurized fluid, the fluid comprising a liquid, a solid, or a mixture of a liquid and a solid, and wherein a front portion of the inner conduit is configured to allow ejection of the fluid during use, wherein the inner conduit and the outer conduit are composed of a flexible material, and wherein the front portion of the inner conduit and the front portion of the outer conduit move when gas is ejected from the outer conduit, and wherein the fluid is pulled from the fluid supply source through the inner conduit when gas is ejected from the outer conduit such that the fluid is mixed with the ejected gas, wherein the nozzle further comprises a regulating member positioned proximate to the outer conduit, and an annular whisk coupled to an opening end of the regulating member.

2. The fluid spraying nozzle of claim 1, further comprising a balancing member coupled to the outer conduit, wherein the balancing member is configured to control movement of the front portion of the outer conduit and the front portion of the inner conduit during use.

3. The fluid spraying nozzle of claim 1, wherein the regulating member is configured to limit movement of the front portion of the outer conduit and the front portion of the inner conduit during use.

4. The fluid spraying nozzle of claim 1, wherein the outer conduit and the inner conduit are composed of a flexible synthetic resin.

5. The fluid spraying nozzle of claim 1, wherein the gas is compressed air, and wherein the pressurized gas supply source comprises a compressor.

6. The fluid spraying nozzle of claim 1, wherein fluid supply source is configured to supply a cleaning liquid.

7. The fluid spraying nozzle of claim 1, wherein fluid supply source is configured to supply abrasive particles.

8. The fluid spraying nozzle of claim 1, wherein fluid supply source is configured to supply a mixture of a liquid and abrasive particles.

9. The fluid spraying nozzle of claim 1, further comprising a plurality of balancing members coupled to the outer conduit.

10. The fluid spraying nozzle of claim 1, wherein the regulating member is configured to limit movement of the front portion of the outer conduit and the front portion of the inner conduit during use, wherein the regulating member is in a substantially conical shape and substantially surrounds the front portion of the outer conduit and the front portion of the inner conduit.

11. The fluid spraying nozzle of claim 1, wherein the regulating member is configured to limit movement of the front portion of the outer conduit and the front portion of the inner conduit during use, wherein the regulating member is an annular member that surrounds a portion of the outer conduit.

12. A fluid spraying apparatus comprising:

a body;

a nozzle disposed in the body, the nozzle comprising an outer conduit and an inner conduit positioned within at least a portion of the outer conduit such that a gap is formed between the outer conduit and the inner conduit;

a pressurized gas supply source coupled to the outer conduit; and a fluid supply source coupled to the inner conduit, the fluid supply source being configured to supply a non-pressurized fluid, the fluid comprising a liquid, a solid, or a mixture of a liquid and a solid, wherein the fluid supply source comprises a fluid container that is removably attached to the body;

wherein a back portion of the outer conduit is coupled to the pressurized gas supply source, wherein a back portion of the inner conduit is coupled to the fluid supply source, and wherein a front portion of the inner conduit is configured to allow ejection of the fluid during use, wherein the inner conduit and the outer conduit are composed of a flexible material, and wherein the front portion of the inner conduit and the front portion of the outer conduit move within the body when gas from the pressurized gas supply source is ejected from the outer conduit, and wherein the fluid is pulled from the fluid supply source through the inner conduit when gas is ejected from the outer conduit such that the fluid is mixed with the ejected gas.

13. The fluid spraying apparatus of claim 12, further comprising a balancing member coupled to the outer conduit, wherein the balancing member is configured to control movement of the front portion of the outer conduit and the front portion of the inner conduit during use.

14. The fluid spraying apparatus of claim 12, further comprising a regulating member coupled to the outer conduit, wherein the regulating member is configured to limit movement of the front portion of the outer conduit and the front portion of the inner conduit during use.

15. The fluid spraying apparatus of claim 12, wherein the pressurized gas source comprises a compressed air source.

16. The fluid spraying apparatus of claim 12, further comprising a valve coupled to the fluid supply source and the inner conduit, wherein the valve is configured to control movement of the fluid from the fluid supply source to the inner conduit.

17. The fluid spraying apparatus of claim 12, wherein the pressurized gas supply comprises an aerosol gas.

18. The fluid spraying apparatus of claim 12, wherein the fluid comprises a cleaning liquid.

19. A method of applying a fluid to a surface comprising:

providing a fluid spraying apparatus, the fluid spraying apparatus comprising:

a body;

a nozzle disposed in the body, the nozzle comprising an outer conduit and an inner conduit positioned within at least a portion of the outer conduit such that a gas flow path is formed between the outer conduit and the inner conduit;

a pressurized gas supply source coupled to the outer conduit; and a fluid supply source coupled to the inner conduit, the fluid supply source being configured to supply a non-pressurized fluid, the fluid comprising a liquid, a solid, or a mixture of a liquid and a solid;

passing gas through the outer conduit, wherein passage of gas through the outer conduit pulls fluid from the fluid supply source through and out of the inner conduit; and wherein the front portion of the inner conduit and the front portion of the outer conduit move within the body when gas from the pressurized gas supply source passes through the outer conduit; and directing the fluid passing out of the inner conduit toward the surface.

20. The method of claim 9, wherein the surface comprises a vehicle surface.

21. A fluid spraying apparatus comprising:

a body;

a nozzle disposed in the body, the nozzle comprising an outer conduit and an inner conduit positioned within at least a portion of the outer conduit such that a gas flow path is formed between the outer conduit and the inner conduit;

a pressurized gas supply source coupled to the outer conduit; and a fluid supply source coupled to the inner conduit, the fluid supply source being configured to supply a non-pressurized fluid, the fluid comprising a liquid, a solid, or a mixture of a liquid and a solid, wherein the fluid supply source comprises a fluid container that is removably attached to the body;

wherein a back portion of the outer conduit is coupled to the pressurized gas supply source, wherein a back portion of the inner conduit is coupled to the fluid supply source, wherein the front portion of the inner conduit is positioned in a negative pressure area that is formed in the outer conduit when gas is ejected from the second conduit during use, and and wherein the front portion of the inner conduit and the front portion of the outer conduit move within the body when gas from the pressurized gas supply source is ejected from the outer conduit, and wherein the fluid is pulled from the fluid supply source through the inner conduit when gas is ejected from the outer conduit such that the fluid is mixed with the ejected gas.

22. The fluid spraying apparatus of claim 21, further comprising a balancing member coupled to the outer conduit, wherein the balancing member is configured to control movement of the front portion of the outer conduit and the front portion of the inner conduit during use.

23. The fluid spraying apparatus of claim 21, further comprising a regulating member positioned proximate to the outer conduit, wherein the regulating member is configured to limit movement of the front portion of the outer conduit and the front portion of the inner conduit during use.

24. The fluid spraying apparatus of claim 21, wherein the outer conduit and the inner conduit are composed of a flexible synthetic resin.

25. The fluid spraying apparatus of claim 21, wherein the gas is compressed air, and wherein the pressurized gas supply source comprises a compressor.

26. The fluid spraying apparatus of claim 21, wherein fluid supply source is configured to supply a cleaning liquid.

27. The fluid spraying apparatus of claim 21, wherein fluid supply source is configured to supply abrasive particles.

28. The fluid spraying apparatus of claim 21, wherein fluid supply source is configured to supply a mixture of a liquid and abrasive particles.

29. The fluid spraying apparatus of claim 21, further comprising a plurality of balancing members coupled to the outer conduit.

30. The fluid spraying apparatus of claim 21, further comprising a regulating member positioned proximate to the outer conduit, wherein the regulating member is configured to limit movement of the front portion of the outer conduit and the front portion of the inner conduit during use, wherein the regulating member is in a substantially conical shape and substantially surrounds the front portion of the outer conduit and the front portion of the inner conduit.

31. The fluid spraying apparatus of claim 21, further comprising a regulating member positioned proximate to the outer conduit, wherein the regulating member is configured to limit movement of the front portion of the outer conduit and the front portion of the inner conduit during use, wherein the regulating member is in a substantially conical shape and substantially surrounds the front portion of the outer conduit and the front portion of the inner conduit, and wherein an annular whisk is coupled to an opening end of the regulating member.

32. The fluid spraying apparatus of claim 21, further comprising a regulating member positioned proximate to the outer conduit, wherein the regulating member is configured to limit movement of the front portion of the outer conduit and the front portion of the inner conduit during use, wherein the regulating member is an annular member that surrounds a portion of the outer conduit.

33. A method of cleaning a surface of a vehicle, comprising:

providing a fluid spraying apparatus, the fluid spraying apparatus comprising:

a body;

a nozzle disposed in the body, the nozzle comprising an outer conduit and an inner conduit positioned within at least a portion of the outer conduit such that a gas flow path is formed between the outer conduit and the inner conduit;

a pressurized gas supply source coupled to the outer conduit; and a fluid supply source coupled to the inner conduit, the fluid supply source being configured to supply a non-pressurized fluid, the fluid comprising a liquid, a solid, or a mixture of a liquid and a solid, wherein the fluid supply source comprises a container that is removably attached to the body;

passing gas through the outer conduit, wherein passage of gas through the outer conduit pulls fluid from the fluid supply source through and out of the inner conduit; and wherein the front portion of the inner conduit and the front portion of the outer conduit move within the body when gas from the pressurized gas supply source passes through the outer conduit; and directing the fluid passing out of the inner conduit toward the surface of the vehicle.

34. The method of claim 33, wherein the vehicle is an automobile.

35. The method of claim 33, further comprising removing the fluid supply source from the body, and refilling the fluid supply source.

* * * * *

UNITED STATES PATENT AND TRADEMARK OFFICE

CERTIFICATE OF CORRECTION

PATENT NO. : 6,883,732 B2
DATED : April 26, 2005
INVENTOR(S) : Kaga Hasegawa

It is certified that error appears in the above-identified patent and that said Letters Patent is hereby corrected as shown below:

Column 10,
Line 39, please delete "claim 9" and substitute therefor -- claim 19 --.

Signed and Sealed this

Second Day of August, 2005

JON W. DUDAS
*Director of the United States Patent and Trademark Office*